United States Patent [19]

Shepard

[11] 4,203,053

[45] May 13, 1980

[54] LOW VOLTAGE DISTRIBUTION SYSTEM FOR MINIATURE STRUCTURE

[76] Inventor: Franziska M. Shepard, 333 E. Las Flores, Santa Maria, Calif. 93454

[21] Appl. No.: 872,022

[22] Filed: Jan. 24, 1978

[51] Int. Cl.[2] ..... H05B 39/00; A63H 33/42

[52] U.S. Cl. ..... 315/254; 174/70 C; 174/72 TR; 46/12; 315/312; 307/147; 339/96

[58] Field of Search ..... 315/254, 312; 339/96, 339/98, 99 L, DIG. 1; 174/70 C, 72 TR, 126 R, DIG. 8; 307/147; 46/12, 13

[56] References Cited

U.S. PATENT DOCUMENTS

| | | | |
|---|---|---|---|
| 2,749,382 | 6/1956 | Lockard | 174/70 C X |
| 3,524,921 | 8/1970 | Wolf | 174/70 C |

FOREIGN PATENT DOCUMENTS

| | | | |
|---|---|---|---|
| 18414 | of 1899 | United Kingdom | 339/96 |

OTHER PUBLICATIONS

Shrinkable Tubing, Product Description of Alpha Wire Corp., N.Y., N.Y.

*Primary Examiner*—Eugene R. LaRoche
*Attorney, Agent, or Firm*—Daniel J. Meaney, Jr.

[57] ABSTRACT

A low voltage distribution system for a miniature structure having a step down transformer which is energized from a high voltage alternating current source to produce a low voltage signal, a pair of elongated bus bar strips formed of a conductive metal foil layer and an adhesive bottom layer which is used to affix the bus bar to the miniature structure with the bus bars being positioned in a spaced parallel relationship, electrical conductors for applying the low voltage signal across the spaced parallel bus bar strips, a plurality of bi-prong electrical fastening devices which have sharp ends to pierce and drive through the bus bar strips forming an electrical connection therewith and into holding relationship with the section of the miniature structure under the bus bar strips and a plurality of light bulbs electrically connected across the bi-prong electrical fastening devices wherein the light bulbs are responsive to the low voltage signal to become illuminated is shown.

14 Claims, 13 Drawing Figures

LOW VOLTAGE DISTRIBUTION SYSTEM FOR MINIATURE STRUCTURE

BACKGROUND OF THE INVENTION

1. Field of the Invention

This invention relates to a novel and unique low voltage distribution system to wire a miniature structure with an electrical circuit which cooperates with bi-prong electrical fastening members which function as an electrical connector to plug an electric light bulb to the electrical circuit in the miniature structure. In particular, this invention relates to an easily installed electrical wiring system using an adhesive backed conductive foil tape as the bus bar for the system. The bi-prong electrical fastening devices can be plugged into and unplugged from the bus bar strips at any desired location.

2. Disclosure of the Prior Art

It is known in the art to utilize low voltage lighting systems for miniature structures. Typically, the wiring takes the form of insulated electrical conductors extending from a voltage source, such as a battery or step-down transformer, directly to a light bulb. Each light has its own pair of conductors which extend throughout the miniature structure.

It is also known to install wiring within a miniature structure in the form of a distribution circuit having a plurality of junctions or connecting points wherein conductors are electrically connected at the connecting points by a soldered connection. Addition of a lamp or relocating a lamp requires soldering or mechanically disconnecting the lamp.

Other known low voltage distribution systems utilize electrical connectors having female and male components. Other systems utilize a variety of electrical conductors and connecting devices, all of which require tools or following precise installation techniques.

SUMMARY OF THE INVENTION

The novel and unique low voltage distribution system for miniature structures, such as doll houses or other model buildings, of the present invention overcomes several disadvantages of the prior art. One advantage of the present invention is that a main bus bar for the distribution system is formed by a pair of elongated bus bar strips having a conductive metal foil top layer and an adhesive bottom layer. The strips are easily installed by peeling off a removable backing member exposing the adhesive layer. The bus bar strips are affixed to the walls of the miniature structure in a parallel spaced relationship. The distance between the center line of the strips is selected to be a predetermined distance. The predetermined distance is at least equal to the transverse width or geometrical dimension of the strips. Bi-prong electrical fastening devices having two sharp points are pushed into the bus bar, pierce and pass through the parallel strips, forming an electrical connection with the strips. The points engage the wall of the miniature structure and are held in place. A light bulb is connected by wires across the bi-prong plug.

Another advantage is that the bus bar strips are easily formed into 90° angles or other angles by folding the strips to obtain the desired angle. Prior art devices require staples or adhesive holding devices to hold insulating wires. Depending on the distribution system of the prior art devices, an electrical connection requires tools, soldering or some method of insuring a dependable mechanical and electrical connection.

Another advantage of the present invention is that the bi-prong electrical fastening device is easily installed by pushing the device into the miniature structure wall in the same manner as a tack of similar device. If it is desired to remove or relocate a lamp, the bi-prong plug is easily pulled out and reinserted.

Yet another advantage of the present invention is that branch bus bar circuits can be fabricated by folding the end against itself forming a mating terminal. The mating terminal is placed into contact at any desired location on the main bus bar to form sub-distribution circuits.

A yet further advantage of the present invention is that a lamp can be attached to a bi-prong plug by winding wires together and forming a tight insulating seal therearound by use of a heat-shrinkable tube or cylinder.

BRIEF DESCRIPTION OF THE DRAWING

The foregoing and other advantages and features of the invention will be apparent from the following description of the preferred embodiment of the invention when considered together with the illustrations in the accompanying drawings and includes the following figures.

DESCRIPTION OF THE PREFERRED EMBODIMENT

Figure 1:
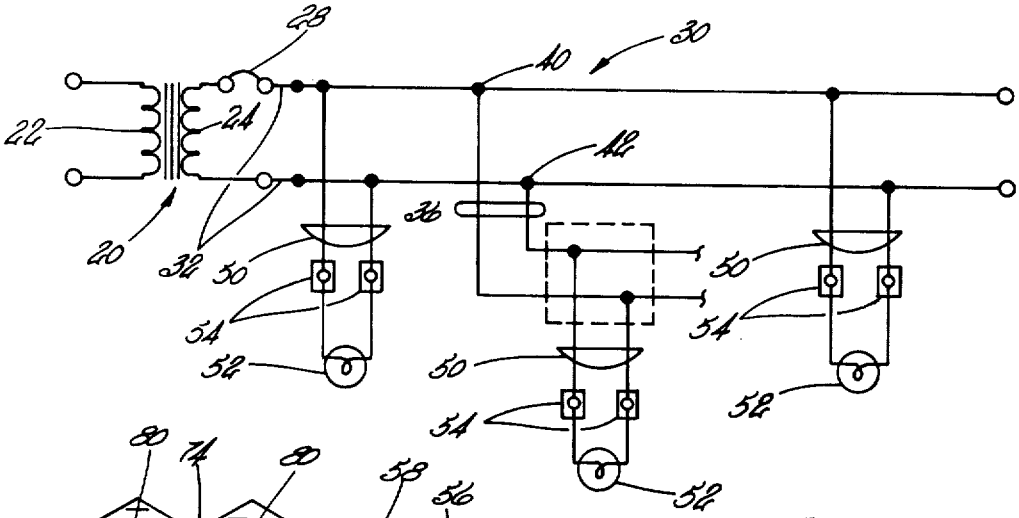
FIG. 1 is a schematic diagram showing the low voltage distribution system having bi-prong plugs and lamp connected thereto.

The schematic diagram of FIG. 1 includes a means for producing a low voltage signal such as, for example, a step down transformer 20. In the preferred embodiment, a primary winding 22 of transformer 20 is electrically connected across a 120 volt 60 hertz source. A secondary winding 24 produces a low voltage, 60 hertz signal thereacross such as 12 volts A.C. The low voltage source could be a direct current source such as batteries.

The transformer 20 may include a detecting and limiting device 28 to detect and limit the current flow through the secondary winding 24. If the transformer becomes overloaded due to high current flow, the device 28 opens. A thermal cutout may be used as one such device. The transformer may be a 120/12 volt 60 hertz U.L. approved Class 2 transformer.

A main bus bar, shown generally as 30, is electrically connected to the secondary winding 24 by electrical conductors 32.

A branch bus bar, shown generally as 36, is attached or connected to the main bus bar 30 through a pair of mating contacts shown as 40 and 42.

Bi-prong electrical fastening devices shown as 50 are inserted into the bus bar to make electrical contact. Each bi-prong plug 50 has a lamp 52 connected thereto. The connections are made through sealed electrical connectors 54.

Figure 2:
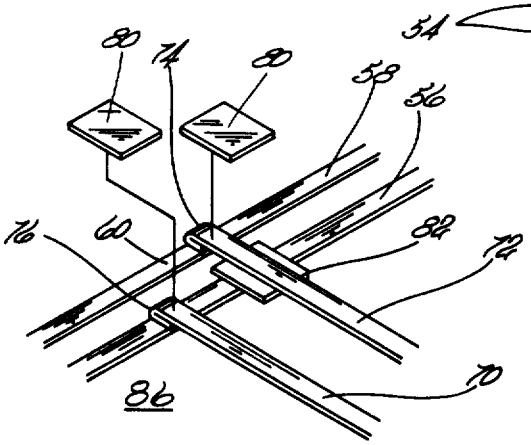
FIG. 2 is a perspective view of a contacting mating connection between a main bus bar and a branch bus bar.

FIG. 2 illustrates the main bus bar 30 is formed of two spaced parallel strips 56 and 58 each having a conductive metal foil top layer 60 and an adhesive bottom layer 62. The width of the strip is of a selected geometrical dimension. The bus bar's two elongated strips 56 and 58 are spaced with the center lines 64 and 66, respectively, spaced a predetermined distance. The predetermined distance, in the preferred embodiment, is at least equal to the width of strips 56 and 58.

A branch bus bar having two elongated strips 70 and 72, which is of the same material and construction as strips 56 and 58, has the one end thereof folded back upon itself with the adhesive layer of the folded end in contact with and adhering to the adhesive layer of the unfolded bus bar strip to form coplanar mating contacts 74 and 76. The coplanar mating contacts 74 and 76 are in mating electrical contact with the conductive metal top foil 60. Pieces of adhesive tape 80 are affixed to mating contacts 74 and 76, and a piece of adhesive tape 82 is located between strips 56 and 72. A section of the miniature structure is shown as 86.

Figure 3:
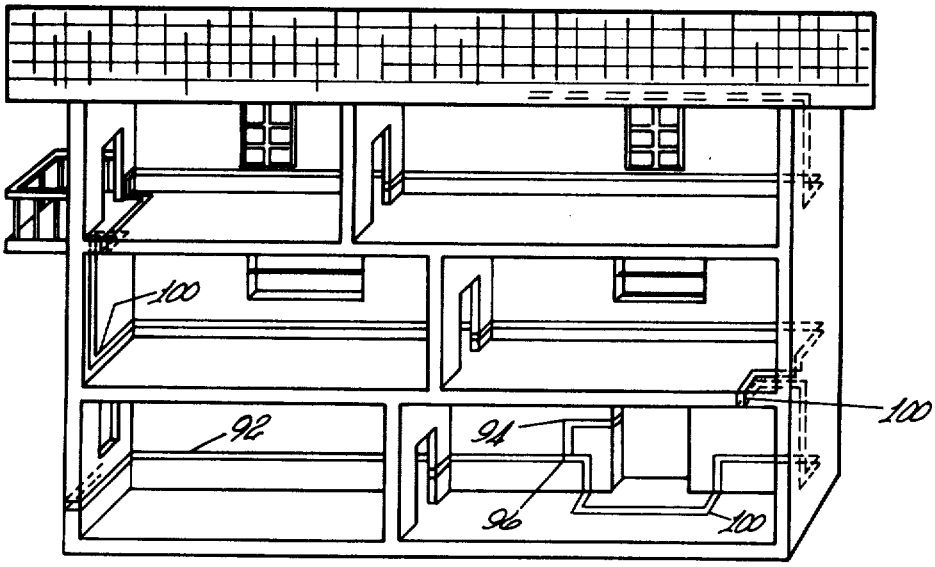
FIG. 3 is a pictorial representation of a doll house having a pair of spaced parallel elongated strips as the main bus bar and branch bus bar.

FIG. 3 shows a miniature structure 90 having a main bus bar 92 and a branch bus bar 94. The mating connection is shown as 96. Several right angle turns in the bus bar are shown by 100. A typical wiring pattern extends through three stories.

Figure 4:
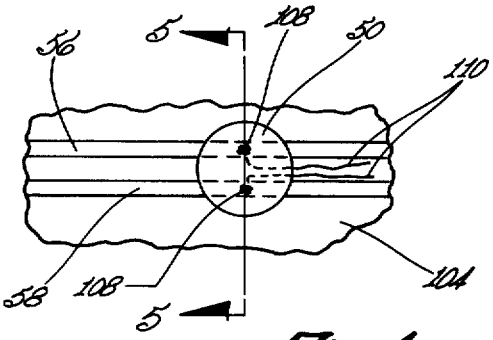
FIG. 4 is a diagrammatic representation of a section of bus bar having a bi-prong electrical fastening device inserted therein.

FIG. 4 shows a top view of a section 104 of the miniature structure having bus bar strips 56 and 58 adhered thereto. The strips 56 and 58 originally and a protective backing which was removed exposing the adhesive. A bi-prong electrical connecting 50 device has conductive fastening members 120 (shown in FIGS. 5 through 8) terminating in an output terminal 108. A pair of insulated electrical conductors 110 is attached to output terminal 108.

Figure 5:
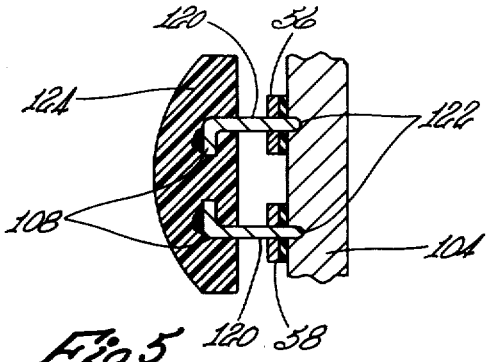
FIG. 5 is a section taken along section lines 5-5 of FIG. 4.

An end sectional view of the bus bar strips 56 and 58 and bi-prong electrical connecting device 50 in FIG. 5 shows that the conductive fastening members 120 terminate in a tapered cutting edge or point 122 adapted to pierce and be driven through the bus bar forming an electrical connection therewith and into fastening engagement with a selected portion 104 of the miniature structure.

The conductive fastening members 120 are spaced a predetermined distance apart and are parallel to each other. Each conductive fastening member 120 terminates in an output terminal 108 having conductors 110 soldered thereto. The housing or body 124 of the bi-prong plug 50 is formed of insulating, cured epoxy well known in the art.

Figure 6:
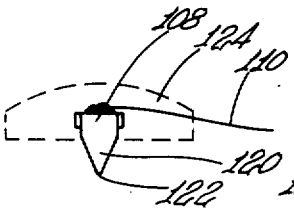
FIGS. 6, 7 and 8 are an end, front and top view of a bi-prong electrical fastening device having a circular cross-section.
Figure 7:
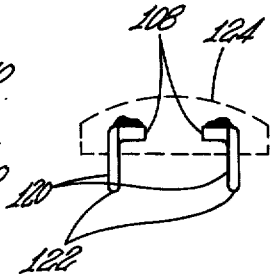
Figure 8:
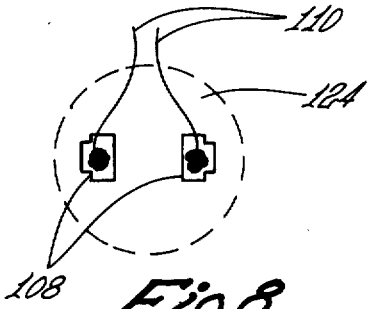

FIGS. 6, 7 and 8 show a bi-prong electrical fastening member having a circular cross-section. The elements are shown in solid line with the body 124 shown in dashed line.

Figure 9:
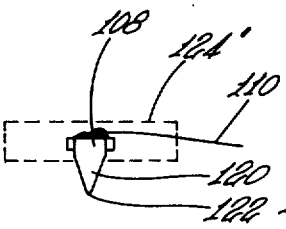
FIGS. 9, 10 and 11 are an end, front and top view of a bi-prong electrical fastening device having a rectangular cross-section.
Figure 10:
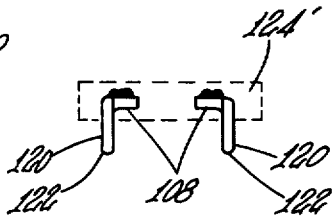
Figure 11:
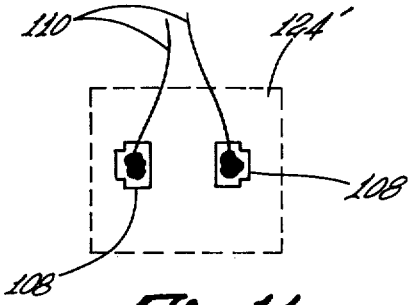

FIGS. 9, 10 and 11 show a bi-prong electrical fastening member having a rectangular cross-section. The elements are shown in solid line with the body 124 shown in dashed line.

Figure 12:
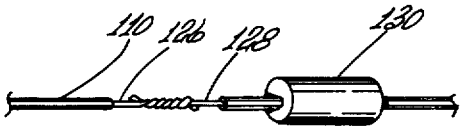
FIG. 12 is a pictorial illustration of twisting an end of a conductor from a bi-prong electrical fastening device with the end of a conductor from a light bulb having a heat shrinkable tube strung on the conductors.
Figure 13:
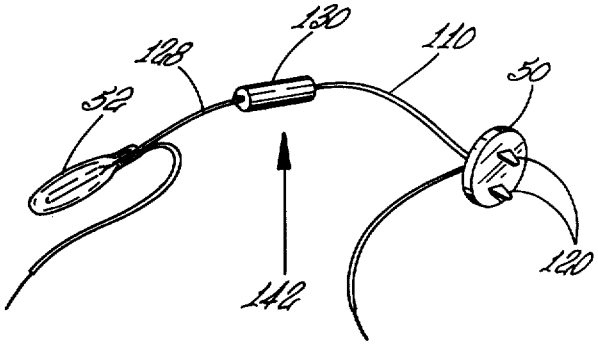
FIG. 13 is a wire lamp and bi-prong electrical fastening device with the heat-shrinkable sealing tube being shrunk to form a tight insulating seal around the twisted electrical connection illustrated in FIG. 12.

FIG. 12 shows an electrical conductor 110 with a conductive end section 126 exposed and twisted together with the end of a conducting lead 128 from a lamp or light bulb 52. A heat-shrinkable tube or cylinder 130 is positioned around each joined connection of the conducting lead 128 and electrical conductor 110. The tube 130 has an axial length sufficient to encapsulate and form a tight, insulating fitting around the connection. FIG. 13 shows the tube 130 and wiring being exposed to a heat source 142 of the right temperature to cause the desired shrinkage.

The system disclosed herein can be assembled into a lighting kit for use in a doll house or for other miniature structures such as that used with model trains, model cities and other hobby type structures. In the preferred embodiment, the kit comprises a transformer, copper tape with an adhesive backing, light bulbs, wires, spring clamps (used as connecting means 32 in FIG. 1) and heat shrinkable tubing.

The connections for providing a 12 volt electrical signal from the two copper tapes and into a lamp or fixture in the structure is obtained by attaching one of the bi-prong plugs to the bulbs or lamps. The two prongs of the plug are pointed and are pressed into and through the copper tapes in a manner similar to insertion and removal of a two-prong fastener.

Installation of the distribution system is fairly simple and can be done without use of tools or soldering equipment. This is of significance in the model or hobby market.

It is also envisioned that the connecting means in FIG. 1 may well be a bi-prong electrical connecting device wherein the electrical conductors are connected to the output of the transformer.

What is claimed is:

1. A low voltage distribution system for a miniature structure comprising means for producing a low voltage signal;

a main bus bar formed of a conductive metal foil top layer and an adhesive bottom layer, said conductive metal foil having a pair of elongated bus bar strips each having a selected geometrical dimension across the width thereof, said strips being positioned in spaced parallel relationship wherein the spacing between the parallel center lines of each elongated bus bar strip is of a predetermined distance which is at least equal to said geometrical dimension and said adhesive layer being adapted to attach the main bus bar to a selected portion of a miniature structure with the conductive metal foil exposed;

means for connecting the low voltage signal to the conductive metal foil layer and producing a voltage potential across said strips; and at least one bi-prong removable electrical fastening device formed of a pair of spaced conductive fastening members each of which are electrically connected to an output terminal, each of said fastening members terminating in an elongated tapered cutting edge, said tapered cutting edges being in spaced parallel relationship and having a dimension therebetween substantially equal to said predetermined distance, and which, when urged into fastening engagement with a said miniature structure, are adapted to pierce, form an elongated slit in and parallel to the center line of each bus bar and be driven through each of the bus bar strips of the main bus bar forming an electrical connection therewith and into fastening engagement with said selected portion of a said miniature structure located under the adhesive layer, and being adapted to terminate said electrical connection with each of the bus bar strips upon removal of the fastening member from fastening engagement with said selected portion of a miniature structure by slideably withdrawing the tapered edges from each bus bar strip leaving a slight elongated slit therein while enabling the strips to maintain a voltage potential thereacross independent of the elongated slit.

2. The system of claim 1 wherein the means for producing a low voltage signal comprises a step down alternating current transformer.

3. The system of claim 2 wherein the low voltage signal producing means includes means for detecting and limiting the current flow through the step down transformer.

4. The system of claim 3 wherein the low voltage signal connecting means includes a pair of transformer leads; and a pair of spring clips electrically connected to the transformer leads and to the main bus bar.

5. The system of claim 1 wherein said bi-prong electrical fastening device includes a pair of separate output terminals electrically connected to said spaced fastening members and having a geometrical distance therebetween which is substantially equal to said predetermined distance.

6. The system of claim 5 further comprising a second bi-prong electrical fastening device identical to said at least one bi-prong electrical fastening device and adapted to pierce and be driven through a different section of the main bus bar forming an electrical connection therewith and into fastening engagement with a selected section of a miniature structure.

7. The system of claim 5 further comprising a branch bus bar having a pair of elongated bus bar strips having a geometrical dimension across the width thereof which is substantially equal to said selected geometrical dimension, a conductive metal foil top layer and an adhesive bottom layer, said branch bus bar strips being positioned in a spaced parallel relationship wherein the spacing between the parallel center lines thereof is substantially equal to said predetermined distance, said branch bus bar strips each having one end thereof folded back upon itself with the adhesive layer of the folded end in contact with and adhering to the adhesive layer of the unfolded bus bar strip to form a coplanar mating contact with the conductive metal foil layer being located on the outer surface of the folded end, one of said mating contacts at the end of each bus bar strip being positioned in mating electrical contact with the conductive metal foil top layer of the main bus bar; and a second removable bi-prong electrical fastening device formed of a pair of spaced conductive fastening members electrically connected to an output terminal, each of said spaced conductive fastening members being electrically connected to a separate output terminal and each of which terminate in an elongated tapered cutting edge, said tapered cutting edges being in spaced parallel relationship and having a dimension therebetween substantially equal to said predetermined distance and which, when urged into fastening engagement with a said miniature structure, are adapted to pierce, form an elongated slit in and parallel to the center line of each branch bus bar strip and be driven through the elongated strips of the branch bus bar forming an electrical connection therewith and into fastening engagement with a section of a said miniature structure located under the adhesive layer, and being adapted to terminate said electrical connection from each of the branch bus bar strips upon removal of the second fastening device conductive fastening member from fastening engagement with said selected portion of a miniature structure by slideably withdrawing the tapered edges from each branch bus bar strip leaving a slight elongated slit therein while enabling the strip to maintain a voltage potential thereacross independent of the elongated slit.

8. The system of claim 7 further comprising a third bi-prong electrical fastening device identical to said second bi-prong electrical fastening device and adapted to pierce and be driven through the branch bus bar forming an electrical connection therewith and into fastening engagement with a selected section of a said miniature structure.

9. The system of claim 3 further comprising a pair of insulated electrical conductors wherein each conductor has one end thereof electrically attached to an output terminal and the other end of the conductor terminating with the conductive end section thereof exposed; and a light bulb capable of being illuminated by the low voltage signal, said light bulb having a pair of conducting leads extending therefrom with each end thereof electrically connected to one of the exposed conductor end sections forming an electrical circuit therewith.

10. The system of claim 9 further comprising a heat-shrinkable cylinder positioned around each joined connection of the conducting lead and electrical conductor, said cylinder having an axial length sufficient to encapsulate and form a tight insulating fitting around said electrical connection.

11. A low voltage distribution system for wiring a miniature structure for electricity comprising a step down voltage transformer adapted to be electrically connected to an alternating current voltage source having a voltage level higher than the desired distribution voltage level for producing a low voltage signal at the level desired for the distribution voltage;

a first and second elongated bus bar strip, each having a selected geometrical dimension across the width thereof and formed of a conductive metal foil top layer and a bottom adhesive layer, said bus bar strips being affixed to a selected section of a said miniature structure and positioned in a spaced parallel relationship with a predetermined distance between the center lines of each strip being at least equal to said selected geometrical dimension;

a pair of electrical connectors extending from the transformer to the bus bar strips for applying the low voltage signal across said bus bar strips having a plurality of bi-prong removable electrical fastening members terminating in a pair of spaced parallel elongated tapered cutting edges having a dimension therebetween substantially equal to said predetermined distance and which, when urged into fastening engagement with said miniature structure, is adapted to pierce, form an elongated slit in and parallel to the center line of each bus bar and be driven into and through the bus bar strips forming a plurality of parallel electrical connections therewith and into fastening engagement with a different selected section of a said miniature structure, each of which are located opposite the fastening member and under the bus bar strips and which is adapted to terminate said electrical connection with each of the bus bar strips upon removal of the fastening member from fastening engagement with said selected portion of a miniature structure by slideably withdrawing from each bus bar strip leaving a slight elongated slit therein while enabling the strips to maintain a voltage potential thereacross independent of the elongated slit; and a plurality of light bulbs each of which has a pair of conducting leads which are electrically connected across one of said bi-prong electrical fastening members, said light bulbs each being in parallel circuit connection to each other and being responsive to the low voltage signal applied across the bus bar to become illuminated.

12. The system of claim 11 wherein the bi-prong electrical fastening member has a round cross-section.

13. The system of claim 12 wherein the bi-prong electrical fastening member has a rectangular cross-section.

14. A miniature structure low voltage distribution system having a main bus bar formed of a conductive metal foil layer which is affixed to the miniature structure by an adhesive bottom layer, said main bus bar having a pair of spaced parallel elongated bus bar strips each having a selected geometrical dimension across the width thereof and with the spacing between the center lines of the parallel strips being a predetermined distance, said distribution system comprising at least one bi-prong removable electrical fastening device formed of a pair of spaced conductive fastening members each of which are electrically connected to an output terminal, each of said fastening members terminating in an elongated tapered cutting edge, said tapered cutting edges being in spaced parallel relationship and having a dimension therebetween substantially equal to said predetermined distance, and which, when urged into fastening engagement with a said miniature structure, are adapted to pierce, form an elongated slit in and parallel to the center line of each bus bar and be driven through each of the bus bar strips of the main bus bar forming an electrical connection therewith and into fastening engagement with said selected portion of a said miniature structure located under the adhesive layer, and being adapted to terminate said electrical connection with each of the bus bar strips upon removal of the fastening member from fastening engagement with said selected portion of a miniature structure by slideably withdrawing the tapered edges from each bus bar strip leaving a slight elongated slit therein while enabling the strips to maintain a voltage potential thereacross independent of the elongated slit.

* * * * *